United States Patent [19]

Komp et al.

[11] Patent Number: 4,805,434

[45] Date of Patent: Feb. 21, 1989

[54] METHOD FOR STRAIGHT-LINE DRAWING OF ROUND MATERIAL

[75] Inventors: Karl-Heinz Komp, Aachen-Oberforstbach; Bruno Walczak, Aachen-Eilendorf, both of Fed. Rep. of Germany

[73] Assignee: Schumag AG, Aachen, Fed. Rep. of Germany

[21] Appl. No.: 85,275

[22] Filed: Aug. 10, 1987

Related U.S. Application Data

[63] Continuation of Ser. No. 788,782, Oct. 18, 1985, abandoned.

[30] Foreign Application Priority Data

Oct. 19, 1984 [EP] European Pat. Off. ..... 84112638.6

[51] Int. Cl.[4] ..... B21C 1/04

[52] U.S. Cl. ..... 72/282; 72/281

[58] Field of Search ..... 72/277–282, 72/287, 291, 274, 288

[56] References Cited

U.S. PATENT DOCUMENTS

| | | | |
|---|---|---|---|
| 679,351 | 7/1901 | Williams | 72/291 |
| 2,138,126 | 11/1938 | Smith et al. | 72/278 |
| 2,242,435 | 5/1941 | Parvin et al. | 72/279 |
| 2,379,801 | 7/1945 | Henry | 72/281 |
| 2,588,834 | 3/1952 | Henderson | 72/280 |
| 3,175,385 | 3/1965 | Mitchell et al. | 72/288 |
| 3,431,766 | 3/1969 | Deardorff | 72/287 |
| 3,709,021 | 1/1973 | Jackman | 72/288 |
| 4,045,992 | 9/1977 | Griffiths | 72/288 |
| 4,079,609 | 3/1978 | Hodgekiss | 72/279 |

FOREIGN PATENT DOCUMENTS

| | | | |
|---|---|---|---|
| 96757 | 8/1976 | Japan | 72/281 |
| 549407 | 11/1942 | United Kingdom | 72/467 |
| 603563 | 6/1948 | United Kingdom | 72/288 |
| 655569 | 7/1951 | United Kingdom | 72/279 |
| 1455542 | 11/1976 | United Kingdom | 72/278 |

*Primary Examiner*—Daniel C. Crane

*Attorney, Agent, or Firm*—Herbert L. Lerner; Laurence A. Greenberg

[57] ABSTRACT

Method of straight-line drawing for reducing the cross section of round material, tubing, solid and hollow profiles in at least two drawing stages, which includes feeding material to be drawn with a leading end to a first drawing machine for a first drawing stage, feeding the material to be drawn with the leading end in a straight line downstream of the first drawing machine. Subsequently the material to be drawn is fed with the leading end to at least one second drawing machine having a linearly movable intermittently operable drawing carriage operating at a discontinuous speed at the beginning of the drawing while said first drawing machine is already operating continuously, being disposed downstream of the straight line for at least one second drawing stage. Next, the material to be drawn from the straight line upstream of the second drawing machine is deflected as soon as the leading end of the material to be drawn has reached the second drawing machine, and the length of the deflected material is varied for equalizing differences in feeding speed between said first and second machine.

10 Claims, 6 Drawing Sheets

METHOD FOR STRAIGHT-LINE DRAWING OF ROUND MATERIAL

This application is a continuation of application Ser. No. 788,782, filed Oct. 18, 1985, now abandoned.

The invention relates to a method for the straight-line drawing of round material and tubing as well as solid and hollow profiles for reducing the cross section in at least two drawing passes, wherein at least the second drawing stage is carried out in a drawing apparatus with a drawing carriage which operates intermittently and moves linearly, as well as to an apparatus for carrying out the method.

German Patent DE-PS No. 31 20 820 discloses carriage drawing machines for carrying out the above-mentioned method, which have found acceptance in practical use. Such machines operate in one stage and are capable of achieving a given reduction of the cross section in one drawing stage, depending on the ductility of the material to be drawn. In such a device the drawing carriages move back and fourth in opposite direction. At the beginning of the drawing operation, i.e., during the insertion process, insertion clamping jaws of a drawing carriage are closed exactly at the forward dead center of the first drawing carriage. The material which is ready for drawing is therefore drawn-in without jerking motions during the subsequent forward stroke of the first drawing carriage. The drawing-in jaws are released from the material to be drawn, which is now pulled in, at the end of this pulling-in stroke executed by the first drawing carriage, but not later than the start of the backward stroke of this drawing carriage. This pulling-in process is repeated several times. During this process, the material to be drawn is intermittently pulled-in with the corresponding linear motion of the drawing carriage, by equivalent and alternating closing and opening of the clamping jaws. During this pulling-in process, the material to be drawn is therefore pulled in by the first drawing carriage with individual interruped strokes until the beginning of the material to be drawn is downstream of the second drawing carriage. Then, the material to be drawn can be taken over by the second drawing carriage and the material to be drawn in advanced without jerking through appropriate control of both drawing carriages, resulting in a suitable simultaneous motion.

At the output of such a conventional drawing machine, the material to be drawn is wound on a drum with a radius that is suitable for the material to be drawn. After the material is completely wound onto the drum, it is further transported as a total package of material to the next drawing machine, where the already described and conventional drawing operation is repeated for the next reduction of the cross section, after threading-in. Basically, it would be desirable to make do without this intermediate winding on the drum of the material to be drawn or at least with as few intermediate winding operations as possible for the material to be drawn,and to pass on the material to be drawn directly from one drawing machine to the next. However, this is not possible with such straight-line drawing machines because, as just described, the drawing machine operates intermittently during the pulling-in operation and therefore forces hesitations of the material to be drawn, while the preceding drawing machine is in the middle of its operation, which therefore forces a continuous transport for the material. Added to this is the additional fact that both drawing machines which must be disposed in tandem, do not operate with exactly the same flow velocity of the mass of the material to be drawn, so that for this reason as well, it does not seem possible to couple straight-line drawing machines in tandem. Thus, intermediate winding operations on drums which interrupt the drawing process proper, are necessary if such drawing machines are used.

It is accordingly an object of the invention to provide a method and apparatus for straight-line drawing of round material and tubing as well as solid and hollow profiles which overcomes the hereafore-mentioned disadvantages of the heretofore-known methods and devices of this general type, and with which it becomes possible to connect straight-line drawing machines in tandem and to avoid the intermediate winding-up operations which have been necessary heretofore.

With the foregoing and other objects in view there is provided, in accordance with the invention, a method of straight-line drawing for reducing the cross section of round material, tubing, solid and hollow profiles in at least two drawing stages or passes, wherein at least the second stage is carried out in a drawing machine, which comprises feeding material to be drawn with a leading end to a first drawing machine for a first drawing stage, feeding the material to be drawn with the leading end in a straight line downstream of the first drawing machine, feeding the material to be drawn with the leading end to at least one second drawing machine with a linearly movable and intermittently operable drawing carriage not in the first drawing machine downstream of the straight line for at least one second drawing stage, and deflecting the material to be drawn from the straight line upstream of the second drawing machine as soon as the leading end of the material to be drawn has reached the second drawing machine. This deflection from a straight line of the material to be drawn provides a buffer region for the motion of the material to be drawn so that the preceding drawing machine which operates in a continuous drawing process, can transport the material to be drawn into this generated arc in an undisturbed manner, while the subsequent drawing machine can take over the arriving material to be drawn in intermittent operation during the start of the drawing. Any material which is supplied too fast be the preceding drawing machine simply flows into the deflected part due to the deflection of the material to be drawn and enlarges this arc as much as necessary. This surprisingly simple measure for the first time permits the connection of straight-line drawing machines directly in tandem, without performing an intermediate drum wind-up of the material to be drawn and yet allowing them to work simultaneously. The material to be drawn remains in continuous flow and the drawing process need not be interrupted to carry out winding operations and transport operations.

With the objects of the invention in view there is also provided an apparatus for reducing the cross section of round material, tubing, solid and hollow profiles by straight-line drawing in at least two stages, comprising a first drawing machine, at least one second drawing machine disposed downstream of said first drawing machine along a given straight travel and working direction of material to be drawn, at least said second drawing machine having a drawing die for straight drawing, and guiding means interconnecting said drawing machines for guiding the material to be drawn to the drawing die of said second drawing machine and for deflecting the material to be drawn from said given straight travel direction. In this way, a drawing device adjacent a preceding drawing device can be connected directly to the preceding drawing device by the interposition of the guiding means, so that the material to be drawn can be passed on with the guiding means from one machine to the next, while providing for the necessary deflection of the material from the straight flow direction in the guiding means, by developing the necessary arc for buffering the material to be drawn. Once a deflection from the straight flow direction is generated, an enlargement of the generated part is carried out automatically. Furthermore, it is only necessary to consider one enlargement, because the material to be drawn is ejected during the intermittent operation of the second drawing device faster than it can be taken over by the second drawing device.

In accordance with another feature of the invention of the instant application, the guiding and deflecting means include a guiding device and a deformation device, at least the deformation device being movably guided for deforming the material to be drawn. In this case,the guiding device carries out the straight-line guidance, while the deformation device provides for the deflection from the straight travel direction. In this way,the functions "guidance" and "deflection" can advantageously be separated. The straight-line guidance is maintained as long as possible and the, if necessary,the deformation is initiated by the independent deformation device.

In accordance with a further feature of the invention of the instant application, the first drawing machine has an outlet, the second drawing machine has an inlet, the guiding device is a V-shaped channel connected between the outlet of the first drawing machine and the inlet of the second drawing machine for guiding the material to be drawn in the given straight travel direction, the channel has at least one interruption formed therein along the length thereof, and the deformation device is movable transversely to the given straight travel direction through the interruption. The V-shaped guiding channel is a particularly simple guiding device with a sufficiently reliable operation. The channel can be interrupted in its lengthwise course without difficulty or loss of its function, so that in the region, a deformation device which can be moved through this region, can be provided for deflecting the material to be drawn from straight travel direction. It is particularly advantageous in this case if this deformation device is provided approximately in the middle of the distance between the two drawing machines. In this way,the force for the deformation which must be supplied to the material to be drawn by the deformation device can be kept small and a uniform deflection on both sides is achieved in the travel direction.

In accordance with an additional feature of the invention of the instant application there is provided, means for moving the V-shaped channel for ending the straight travel direction before deforming the material to be drawn. It is possible through the use of these simple means to choose the radial plane in which the deformation is to be made, independently of the angular position of the V-shaped channel. Then, the radial deformation plane need not of necessity be located in such a way that the material to be drawn is lifted from the V-shaped channel by the deformation process, but the V-shaped channel can rather be movable so that is gives way to the material to be drawn that is being deformed.

In accordance with an added feature of the invention of the instant application there is provided, means for lowering the V-shaped channel. This is a direction of movement of the channel which can be provided simply.

In accordance with still another feature of the invention of the instant application there is provided, means for pivoting the V-shaped channel about an axis parallel to the length thereof. This possible motion can also be provided simply and permits the channel to give way to the desired direction of deformation of the material to be drawn.

In accordance with still a further feature of the invention of the instant application, the deformation device is a deflection slider being radially movable against the material to be drawn. Such a deflection slider can also be of simple construction, can be moved simply and can be guided radially toward the material to be drawn in a force-locking manner and therefore under continuous desired pretension. A force-locking connection is one in which two elements are locked together by external force, as opposed to a form-locking connection which is accomplished by virtue of the shape of the parts themselves. In this manner, a reliable defection of the material to be drawn is brought about because the deflection slider only rests against the material to be drawn in a force-locking manner, it is possible at the same time to use the deflection slider to follow enlargements as well as reduction of the deflection arc of the material to be drawn without difficulty.

In accordance with still an additional feature of the invention of the instant application, the deflection slider includes an actuating device, a carrier connected to the acting device, and at least one contact element disposed on the carrier for contacting the material to be drawn. This is also a particularly simple construction and with it it is possible to separate the motion and the elements exerting the force from the elements which come directly into contact with the material to be drawn, so that the contact elements can be adapted to the particular requirements of the respective material to be drawn without the need to simultaneously change all other subassemblies or components.

In accordance with still an added feature of the invention of the instant application, at least one contact element is a body being rotationally symmetrical and rotatable on the carrier about at least one axis,the contact element being perpendicular to a tangent at the contact point between the material to be drawn and the contact element. This may involve one or more rollers or wheels, so that on one hand, the bending radius of the material to be drawn can be influenced in a simple manner, and on the other hand, the axial motion is not impeded by unnecessarily great friction. In addition, detrimental influences on the surface fibers of the material to be drawn can be avoided by the reduction of the axial friction.

In accordance with again another feature of the invention of the instant application, the actuating device is a piston-cylinder unit operated by a flowing medium. This is the simplest means for achieving or obtaining the force-locking contact of the part which cause the deflection of the material to be drawn from the straight line.

In accordance with again a further feature of the invention of the instant application, the first drawing machine has an outlet, the second drawing machine has an inlet, and the guiding device includes abutments for restraining the material to be drawn in the vicinity of the outlet and the inlet. In this way, the corresponding guiding elements at the machines which are disposed in the vicinity of the output and the input are relieved of load and a gentle transition arc to the deflection arc can be provided which relieves the load of the material to be drawn itself.

In accordance with again an additional feature of the invention of the instant application, the guiding device being a circular guide guiding the material to be drawn from a tangential emission from the first drawing machine, through a circular-arcuate deflection, and to a tangential insertion into the second drawing machine. With this device it is possible to place machines that follow each other, parallel to each other, so that adaptation to the physical conditions available is possible in an advantageous manner. This is particularly important if the deflection is made along a circular track through about 180°. In multistage drawing processes it is also possible to then place a machine group of several drawing machines initially in tandem and then to place further machines in parallel through a 180° deflection. The deflection along a circular track through about 180° is a particularly advantageous type of buffering, because in such a case almost any velocity differences between the two machines can be intercepted merely by moving the arc of 180° as a whole further from or closer to the two machines mounted parallel to each other. The arc itself can remain unchanged in this case.

In accordance with again an added feature of the invention of the instant application,the guiding device includes a central support, a crossbar support on the central support and pivotable about a vertical axis, the crossbar having a free end movable through a given operating range, and a gripping device disposed on the free end of the crossbar for accepting and transferring the material to be drawn between the first and second drawing machines, the first drawing machine having an outlet and the second drawing machine having an inlet within the given operating range. In this manner, it is possible to generate the desired deflection with relatively simple means and to thereby create the desired deflection and thus, the required buffer zone. It is possible not only to simultaneously couple to drawing machines in series, but also to place them parallel to each other.

In accordance with yet another feature of the invention of the instant application, the drawing machines draw the material to be drawn in parallel operating directions, and the guiding device deflects the material to be drawn through substantially 180°.

In accordance with yet a further feature of the invention of the instant application there is provided, a drive rotationally driving the crossbar. For material to be drawn of larger cross section, this is not required. The crossbar itself which is centrally supported and could be constructed, for instance, as a wheel, can be driven by the working motion of the material to be drawn. In the case of material to be drawn having a smaller cross section, this leads to difficulties because the material to be drawn then buckles at undersirable points. The drive of the crossbar, which must rotate the crossbar in synchronism with the velocity of the arriving material to be drawn, therefore ensures that the buckling at undesirable points of the smaller cross section material to be drawn, is inhibited.

In accordance with a concomitant feature of the invention of the instant application there is provided, additional drawing machines and additional guiding and deflecting means interconnecting the drawing machines. In this manner it is possible to subdivide a drawing operation into as many stages as desired and to nevertheless establish an uninterrupted working process by interlinking all of the drawing machines with each other. An interruption of the drawing process is therefore no longer necessary.

Other features which are considered as characteristic for the invention are set forth in the appended claims.

Although the invention is illustrated and described herein as embodied in method and apparatus for straight-line drawing of round material and tubing as well as solid and hollow profiles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
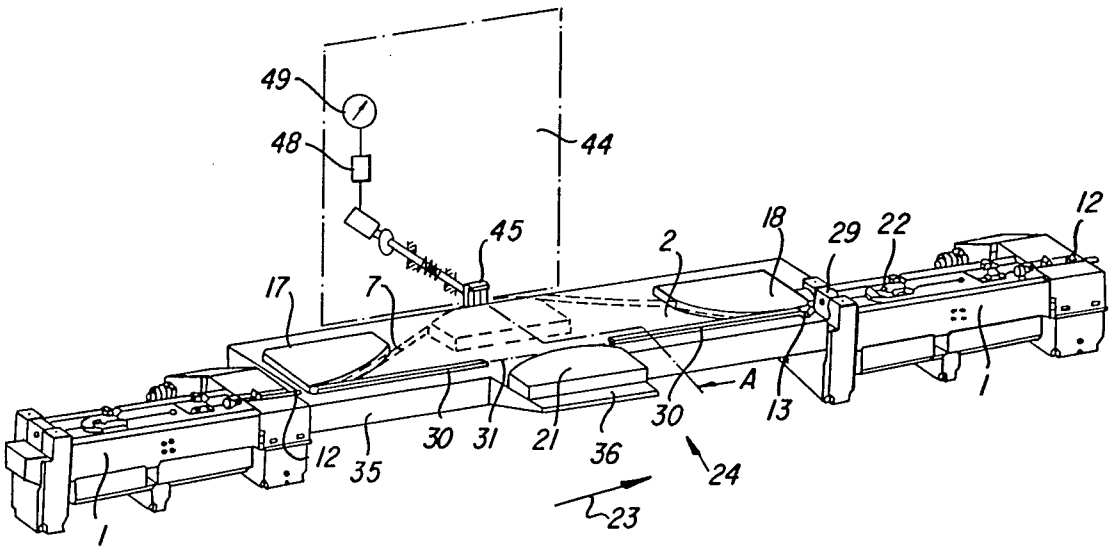
FIG. 1 is a diagrammatic perspective view of a coupling of two drawing machines with an interposed guiding device.

Referring now to the figures of the drawings in detail and first, particularly, to FIG. 1 thereof, there is seen an apparatus 24 according to the invention, in which two drawing machines 1 are interlinked by means of a guiding device 2. The operating direction of the apparatus of a system assembled in this manner is indicated by an arrow 23. Material 7 to be drawn is therefore transported or passed-on in the direction of the arrow 23. In this case, the material 7 to be drawn may be processed in a first drawing stage by the drawing machine 1 disposed to the left of the guiding device 2, through the use of a straight-line drawing process, and the material 7 exits at the outlet 12 of this drawing machine in a straight-line direction.

A bed 35 of the guiding device 2 aligned in the straight direction of the exiting material 7 to be drawn, supports a V-shaped channel or groove 30 which is open toward the top. In the illustrated embodiment, an angle of 90° is chosen as the angle between the two legs or surfaces of the channel. The material 7 to be drawn can travel straight forward through the V-shaped channel, is guided in a straight direction by the channel and is threaded into an inlet 13 of the drawing machine 1 disposed toward right in the system. In the forward or leading region of the material 7 to be drawn, a so-called hook or nose is provided which protrudes through a drawing die 29, so that the material 7 to be drawn can be initially taken over by a drawing carriage 22. If the material 7 to be drawn has travelled the entire distance from the machine at the left through the V-shaped groove up to the drawing die 29 of the drawing machine 1 at the right, the hook or nose at the start of the material to be drawn is disposed in such a way that the drawing carriage 22 can grab the hook or nose for initiating the drawing process. Therefore, the hook protruding through the drawing die 29 is immediately grabbed by the drawing carriage 22. However, since a reduction of the cross section of the material to be drawn takes place in the drawing die 29, more material 7 to be drawn is offered to the right-hand drawing machine by the left-hand drawing machine than can be drawn by the drawing carriage 22 through the drawing die 29. During the beginning of the drawing process, an additional difficulty arises which is that before a continuous drawing operation can set in at the right-hand drawing machine 1, the drawing carriage 22 must first regrip the material to be drawn in several steps as already described regarding the state of the art, so that a complete standstill of the material in the right-hand drawing machine 1 occurs. However, meanwhile, the left-hand drawing machine of the apparatus or installation according to FIG. 1, continues to operate continuously. As a result, the material 7 to be drawn would therefore buckle without taking special measures and the material 7 as well as at least the following drawing machine would be destroyed as well. This problem is eliminated by the guiding device 2. For this purpose, an interruption 31 is provided along the path of the V-shaped channel 30, approximately in the central reion of the portion between the outlet 12 of the left-hand drawing machine and the inlet 13 of the right-hand drawing machine. In this region the bed 35 has a crossbar 36 on which a deformation element 21 is disposed. This deformation element 21 can be moved along the upper plane of the bed, in the radial direction relative to the material to be drawn. For instance, the deformation element 21 can occupy a position which is shown in broken lines in FIG. 1. If the deformation element 21 is moved radially, the material 7 to be drawn is deformed accordingly, i.e., it is deflected from its straight direction. For this purpose, the V-shaped channel 30 can be tilted in the above-described apparatus about an axis 32 shown in FIG. 2, so that the V-shaped channel 30 which is intended as a guide, no longer is an obstacle to a deflection of the material to be drawn. In order to carry out the deflection of the material to be drawn, the deformation element 21 is run radially against the material 7 to be drawn with the necessary force. This force can be generated, for instance, by a piston-cylinder unit 19, shown in FIG. 2. The unit 19 is actuated by a flowing medium and moves the deformation element 21 in the direction of an arrow 37 and vice-versa with the necessary force, by performing the appropriate connection. The force of the piston-cylinder unit 19 is selected in this case in such a way that, while a deflection of the material to be drawn is brought about, the drawing process itself is not unduly influenced thereby. For actuation, the piston-cylinder unit 19 is connected through lines 40 and 41 and through a valve 39 to a pump unit 38 or to a tank 42. In the indicated switching position of the valve 39, the piston-cylinder unit 19 is supplied with pressurized medium by means of the pump unit 38 through the line 40; the pressurized medium ensures that a piston rod of the piston-cylinder unit runs out and that a motion of the deformation element 21 in the direction of the arrow 37 therefore takes place. This is accomplished since the piston rod of the piston-cylinder unit 19 is connected to the deformation element 21 in the manner shown in FIG. 2 or in some other suitable manner. In this case, the cylinder of the piston-cylinder unit is preferably braced against the bed 35 of the guiding device 2. The flowing medium which is displaced from the cylinder space on the piston rod side of the piston-cylinder unit 19 and travels into the tank 42 through the line 41 and through the valve 39. In this case, a controlled counter-pressure valve 43 can ensure that the piston of the piston-cylinder unit 19 remains hydraulically extended or fixed. A motion of the piston rod of the piston-cylinder unit 19 in the reverse direction is achieved by moving the valve 39 into the second switching position.

Figure 2:
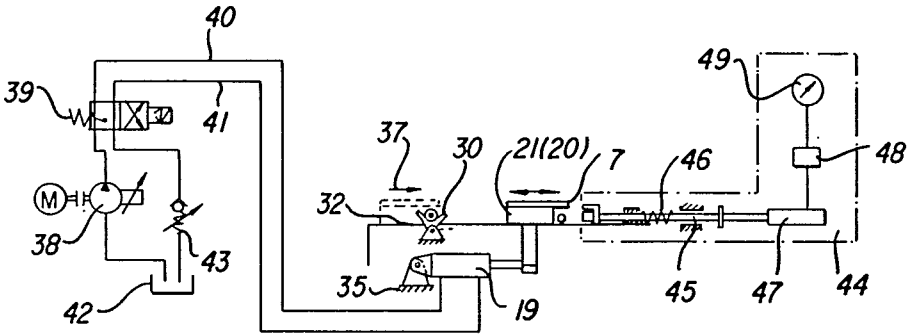
FIG. 2 is a schematic circuit diagram and a fragmentary cross-sectional view taken along the line A-A in FIG. 1 in the . direction of the arrows.

In order to prevent the material to be drawn from being interfered with during the deformation by the V-shaped channel 30, the channel is tilted about the axis 32 and occupies the broken line position shown in FIG. 2.

In order to prevent an undesired deformation of the material to be drawn in the outlet region 12 or in the inlet region 13 of the respective drawing machine 1 due to actuation of the deformation element 21, abutments 17 and 18 may further be provided in the above-mentioned regions which force a given or desired contour of the material 7 to be drawn in this region. In addition, the entire apparatus 24 can also be equipped with a device 44 which checks the magnitude of the radial deformation of the material 7 to be drawn and deliver a corresponding signal. It, therefore, becomes possible to regulate the operating velocities of the drawing machines 1 of the system 24 as a function of the magnitude of the radial bending of the material to be drawn, in such a manner that a trouble-free flow of material is ensured. Impermissible velocity differences in the operating speed of the machines of a system can thus be prevented. This is a particularly important aspect which is also advantageous if, for instance, the drawing machines of an apparatus are refitted by exchanging the drawing guide 29 when processing continuously changing cross sections of the material to be drawn. The matching of the operating speeds of the machines to each other can then be done automatically by means of a device 44. For this purpose, a plunger 45 can be guided radially inwardly from the outside against the material 7 to be drawn. The plunger 45 which can be moved radially is under the pretension of a spring 46. The motions of the plunger 45 in the radial direction are measured by an electronic travel distance transducer 47, which may be in the form of a commercially available linear distance transducer. The pulses of the distance transducer 47 are passed on to a computer 48 which in turn passes its computing results to a suitable indicating device 49. The indicating device 49 can also be omitted and the values of the computer 48 of a control device suitable therefor may be used instead for matching the operating speed of the drawing machines of the installation. Since the construction of a suitable control loop is fundamentally known in the art, this need not be discussed in detail herein.

It is also possible to avoid the tiltability as well as the tilting of the V-shaped channel 30 in the apparatus 24 by tilting the bed 35 of the guiding device 2 through 90° relative to the illustration in FIG. 1. This is done in such a way that the deformation element 21 can then be moved upward from below and can thereby lift the material 7 to be drawn from the V-shaped channel 30, which is to retain its position when the deflection process is carried out. For this purpose, depending on the construction and position of the angle of the V-shaped channel 30, a tilting angle of the bed 35 of less than 90° is sufficient. Overall, the apparatus 24 provides an operable interlinkage of two drawing devices and the two devices, at least the drawing device located to the right in the operating direction is for straight-line drawings.

Figure 3:
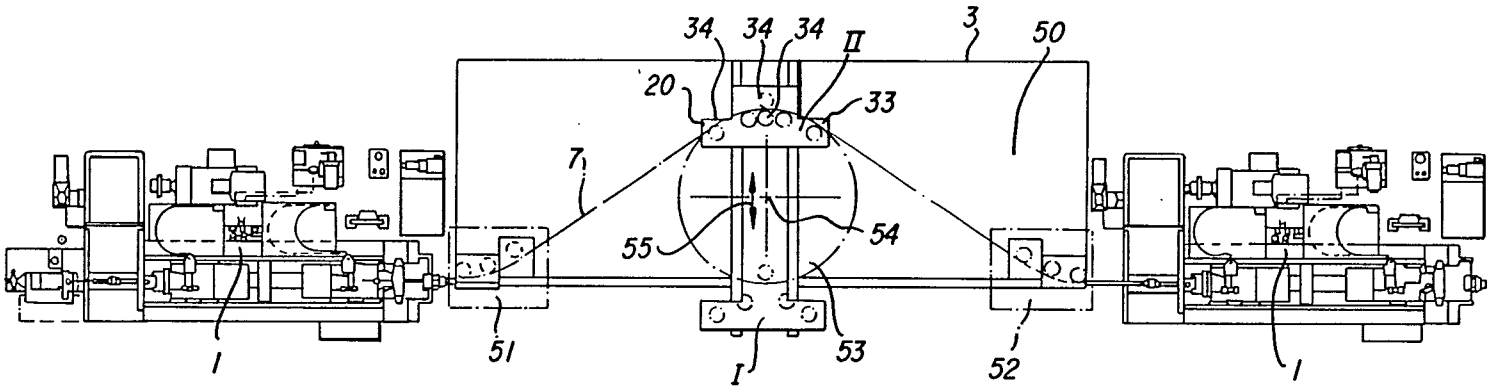
FIG. 3 is a top-plan view of a system according to FIG. 1, but with an altered guiding device.
Figure 6:
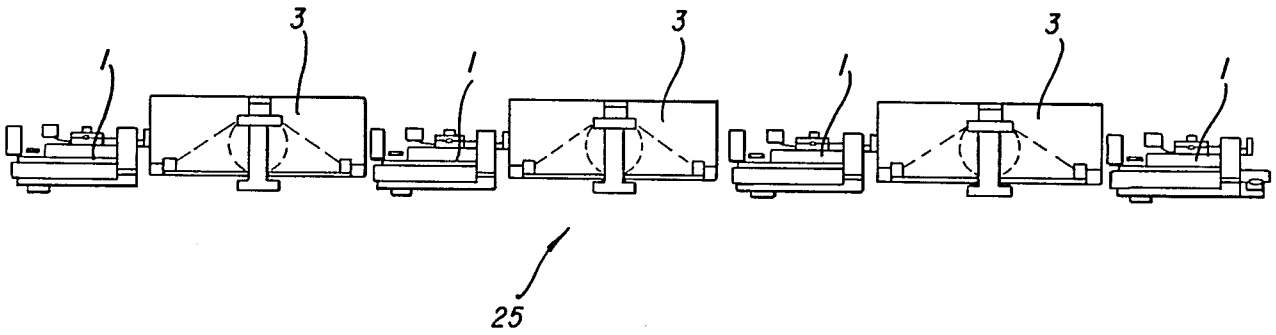
FIG. 6 is a view similar to FIG. 3 but with an interlinkage of more than two drawing machines.

An apparatus as shown in FIG. 1, can be coupled several times in tandem so that an installation 25 according to FIG. 6 is produced. In the plant 25 according to FIG. 6, it is also entirely possible to use guiding devices 2 according to FIG. 1. However, for reasons of further explanation, slightly modified guiding devices 3 have been used as the interlinking means between the individual drawing machines 1. One such guiding device 3 is shown more clearly in FIG. 3. FIG. 3 shows an apparatus with the construction according to FIG. 1 but with an altered guiding device 3. A carrier 33 can be moved in the direction of an arrow 55 in a manner similar to the deformation element 21. The movement occurs on a bed 50 which fulfills a function similar to the bed 35 according to FIG. 1. Contact elements 34 in the form of rotatable rolls, are fastened on the carrier 33 along a circular line. In this case two rolls 34 are oppositely disposed in the central region, between which the material 7 to be drawn is guided. In FIG. 3, position I of the carrier 33 marks the starting position and position II of the carrier 33 marks the permissible end position. In this embodiment, abutments 51 and 52 disposed on the bed 50 fulfill the same function as the abutments 17 and 18 according to FIG. 1. However, the abutments 51 and 52 also have non-illustrated rolls serving as elements for guiding the material 7 to be drawn, a placement similar to the rolls 34 which are disposed on the carrier 33. In a further embodiment, the rolls 34 disposed on the carrier 33 could also be replaced by a wheel 53 indicated by dot-dash line, which would be rotatably supported about an axis 54, also indicated by dot-dash line, on a correspondingly enlarged carrier 33.

The overall guiding device 3, described in connection with FIG. 3, can otherwise be constructed like the guiding device 2 according to FIG. 1. For instance, the V-shaped channel 30 according to FIG. 1 can also be provided in a guiding device according to FIG. 3 and a detailed description thereof has therefore been dispensed with. This also applies to the possible tilted position of the bed 50.

A guiding device according to FIG. 3 has the advantage of permitting all of the guiding elements for the material 7 to be drawn to execute a rolling motion, so that friction between the material to be drawn and the corresponding guiding elements can be largely prevented.

Figure 5:
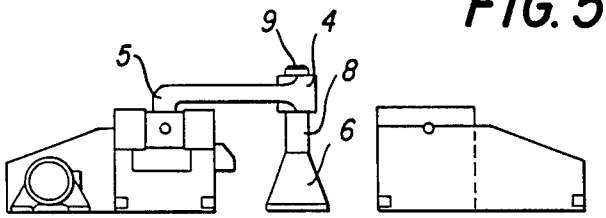
FIG. 5 is a view as seen in the direction of the arrow B according to FIG. 4.
Figure 4:
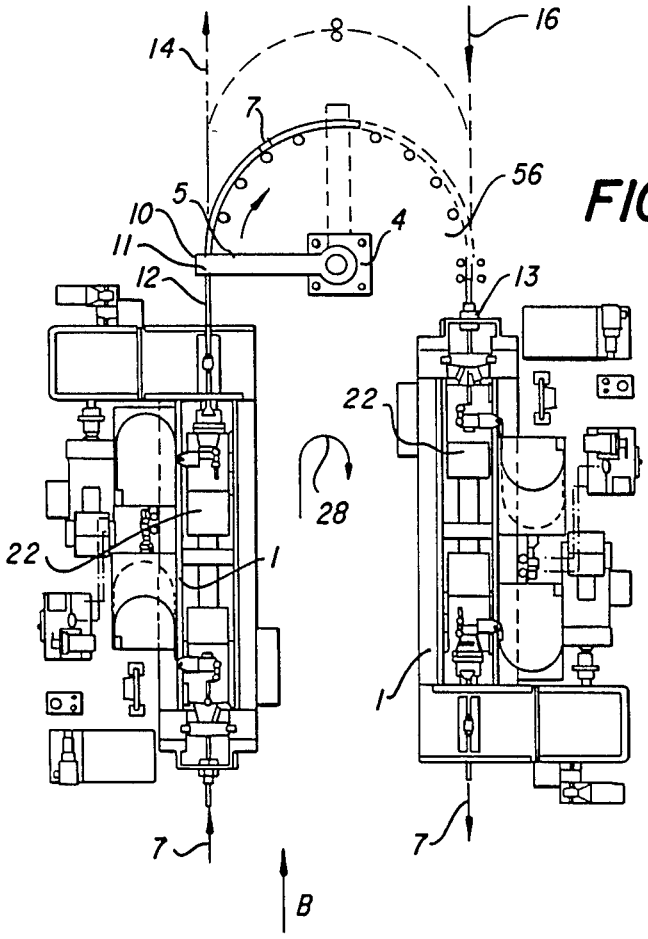
FIG. 4 is a top-plan view of two drawing machines disposed in parallel with a guiding device for guiding the material to be drawn in a circular arc guide.

Another embodiment of the guiding device is shown by the guiding device 4 according to FIGS. 4 and 5. For instance, a guiding device of this type makes it possible to interlink drawing machines 1 in a mutually parallel configuration. In such a guiding device 4, a central support 8 is provided in the form of a column around a vertical axis 9 and a crossbar 5 is rotatably supported on this column about the vertical axis 9. In the embodiment, the crossbar 5 is rotatably driven by a drive 6. The crossbar 5 has a gripping device 11 at its free end 10. In the position shown in FIG. 4, the gripping device 11 of the crossbar 5 can seize the material 7 to be drawn which comes from the outlet 12 of a first drawing machine 1 and can conduct it around in a circular-arc about the vertical axis 9 by executing a rotary motion. In this case, the material 7 to be drawn enters into the gripping device 11 of the crossbar 5 in direction 14 tangential to its circular-arcuate deflection. If the crossbar 5 is rotated about 180°, the beginning of the material 7 to be drawn is introduced into the inlet 13 of the next drawing machine 1 in a direction 16 tangential to the circular arcuate deflection, so that the hook or nose of the material 7 to be drawn can be seized by the drawing carriage 22. The deflection direction and the operating direction are indicated by an arrow 15 in FIG. 4. By means of the guiding device 4, an apparatus 28 can thus be formed in which the individual mutually parallel drawing machines can advantageously be disposed in such a manner that their operating sides face each other, so that both machines can be serviced by a single operator. The circular-arcuate deflection of the material to be drawn between the outlet and the inlet of the two machines of the apparatus 28 can be accomplished very simply and can be controlled very simply, because a higher operating speed of the first machine is simply absorbed or levelled off by an outward motion of the circular arc of the material 7 to be drawn interlinking both machines, as is shown in FIG. 4 by broken lines. For certain properties of the material 7 to be drawn, it may be advantagous if the circular arc formed of the material 7 to be drawn is maintained by a guiding device 56 after it has been established, even if the circular arc of the material 7 to be drawn travels further outward. It is then advantageous, depending on the properties of the material 7 to be drawn, if the guiding device 56 is pressed against the material to be drawn under a slight pretension and if it continuously travels along with the circular arc of the material to be drawn, so that a neat or orderly deflection of the material to be drawn is continuously maintained. The danger of undesirable deformations and buckling of particularly unstable material can thereby be eliminated.

It is also conceivable, depending on the mechanical properties of the material to be drawn, for the drive 6 of the guiding device 4 to be omitted, since the moving material itself can provide the drive for the crossbar 5.

Figure 7:
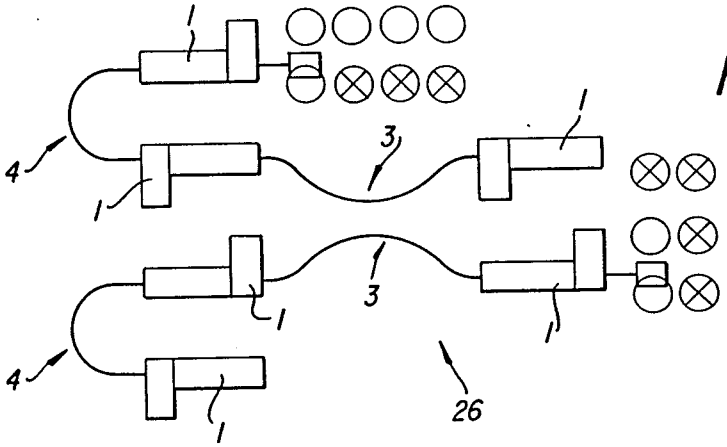
FIG. 7 is a diagrammatic view of a system with two groups of drawing machines, interlinked with different guiding devices.
Figure 8:
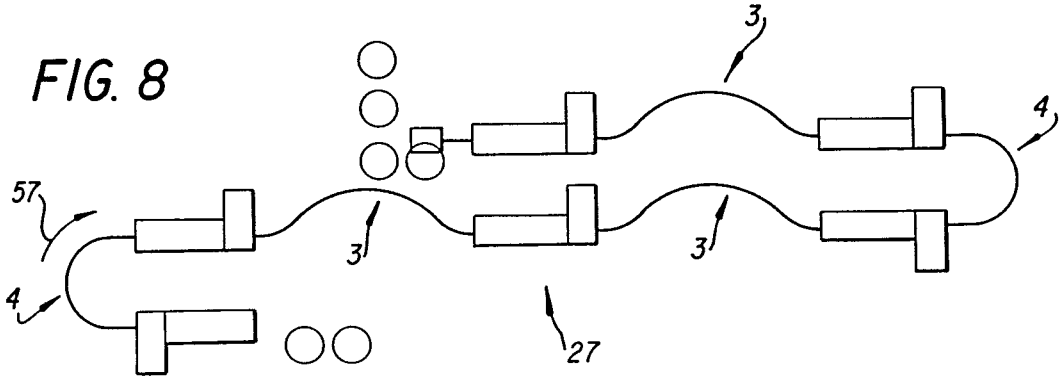
FIG. 8 is a view similar to FIG. 7, but with a six-stage system interlinked with different guiding devices.

In FIGS. 7 and 8, apparatus 26 and 27 are shown diagrammatically which illustrate different configurations and interlinkages of the straight-line drawing machines. It is possible with the two different guiding devices 2 and 3 as well as the guiding device 4, to serially interlink the individual drawing machines in tandem as well as in a mutually parallel configuration or in mutually parallel rows. In this connection, FIG. 7 shows an apparatus 26 which is formed of two groups each having three machines. Two of the machines are disposed parallel to each other and two of the machines are disposed serially in tandem. This construction has the advantage of permitting three machines to be serviced by a single operator. The apparatus therefore permits the operation of six drawing machines with only two operators. For this purpose, one guiding device 4 and one guiding device 3 or 2 are required for both groups.

In the apparatus 27 according to FIG. 8, six machines which are interlinked in tandem can also be serviced by two operators. The apparatus 27 thus permits the performance of a six-stage drawing process without interruption. To this end, two drawing machines are interlinked at the left side of FIG. 8 by a guiding device 4 so that these two machines are disposed parallel to each other. In this case, the operating direction is assumed to be in the direction of an arrow 57 in FIG. 8. The second parallel-interlinked machine is followed, in turn, by a further machine which is connected by a guiding device 3 in a straight-line interlinkage. The subsequent drawing machine (i.e. the fourth stage) is also interlinked with the preceding machine in a straight line by a guiding device 3. However, this machine is followed by a further drawing machine as a fifth stage in a parallel configuration, so that it must be interlinked with the preceding machine by a guiding device 4. A straight-line interlinked machine then follows again as a sixth stage, so that it can be interlinked again to the preceding machine by a guiding device 3. It can be seen in FIG. 8 that it is not only possible to interlink individual machines in a parallel configuration, but that a row of straight-line interlinked machines can also be disposed parallel to a further row of straight-line interlinked machines. The different above-described interlinking devices therefore allow optimum space utilization and interlinkage without interruption, while using as many drawing machines in tandem as desired, so that drawing apparatus with straight-line drawing machines and any desired number of drawing stages can be formed in the most advantageous manner. According to the invention, it is therefore possible for the first time to interlink any number of straight-line drawing machines with each other, so that they can operated in tandem without having to interrupt the drawing process for this purpose. At the same time, it has become possible to construct the interlinkage in such a way that all of the machines can be configured with an extremely advantageous placement and this advantageous configuration additionally permits several machines of an apparatus to be serviced by only one operator. The method according to the invention can, of course, be used for all drawable cross sections of the material to be drawn.

The foregoing is a description corresponding, in substance, to European application 84112638.6, dated Oct. 19, 1984, international priority of which is being claimed for the instant application and which is hereby made part of this application. Any material discrepancies between the foregoing specification and the specification of the aforementioned corresponding German application are to be resolved in favor of the latter.

There is claimed:

1. Method of straight-line drawing for reducing the cross section of round material, tubing, solid and hollow profiles in at least two drawing stages, which comprises feeding material with a leading end to a first drawing machine, drawing the material through the first drawing machine in a first drawing stage, feeding the material with the leading end in a straight line downstream of the first drawing machine, subsequently feeding the material with the leading end to at least one second drawing machine having a linearly movable intermittently operable drawing carriage operating at a discontinuous speed at the beginning of the second drawing stage while said first drawing machine is already operating continuously, being disposed downstream of the straight line, deflecting the material from the straight line upstream of the second drawing machine as soon as the leading end of the material has reached the second drawing machine, and varying the length of the deflected material for equalizing differences in feeding speed between said first and second machine.

2. Method according to claim 1, including additional drawing machines and additional guiding and deflecting means, comprising the step of: interconnecting said additional drawing machines.

3. Method for equalizing differences in drawing speed between a first material drawing machine operating in tandem with a second drawing machine disposed downstream from the first drawing machine, including a straight V-shaped material-guiding channel disposed between said first and second drawing machine having an interruption therein for admitting drawn material to a region of deflected material, disposed between said first and second machine, the method comprising the steps of: drawing the material through the first machine, guiding the drawn material in said channel from the point of material exit of the first machine via said interruption to the point of material entry of the second machine; deflecting the drawn material from said interruption to said region of deflected material in a direction and transverse to and away from said guiding channel; varying the length of the deflected material in response to said differences in drawing speed; drawing the material through the second machine; and moving said channel for ending said straight travel direction before deforming the material.

4. Method according to claim 3, which comprises: pivoting said V-shaped channel about an axis parallel therewith; radially moving said deflected material being drawn by means of a deformation device which includes a deflection slider.

5. Method according to claim 4, which comprises: moving said deflection slider by means of a piston-cylinder unit operated by a flowing medium.

6. Method according to claim 4, which comprises: placing at least two abutments for restraining the material being drawn, in the vicinity of said machine exit and entry.

7. Method for reducing the cross section of round material, tubing, solid and hollow profiles by line drawing in at least two stages, including a first drawing machine, at least one second drawing machine operating at a discontinuous speed at the beginning of the drawing, while said first drawing machine is already operating continuously, disposed downstream of said first drawing machine along a given travel direction of material to be drawn, at least the second drawing machine having a second drawing die for straight drawing, and means for interconnecting the drawing machines and means for interconnecting the drawing machines and means for deflecting the material to be drawn from the given straight travel direction, and a guiding device being a circular guide, the method comprising the steps of: interconnecting said drawing machines; guiding the material to be drawn to the drawing die of the second machine; deflecting the material to be drawn by the second machine from the straight travel direction; drawing said material through a first drawing machine and guiding the drawn material from a tangential emission from said first drawing machine through a circular-arcuate deflection; subsequently feeding the drawn material as a tangential insertion into said second drawing machine; and absorbing the differences in feeding speed between said first and second machine by means of radial motion of the center of said circular-arcuate deflection while said first drawing machine operates continuously and said second drawing machine operates at a discontinuous speed so as to draw the material leading end through said second die.

8. Method according to claim 7, wherein said guiding device includes a cross bar, a central support, a crossbar support on said central support which is pivotable about a vertical axis, said crossbar having a free end movable through a given operating range,and a gripping device disposed on said free end of said crossbar, the method comprising the steps of: accepting and transferring at a discontinuous speed the material to be drawn between said first and second drawing machines, said first drawing machine having an outlet and said second drawing machine having an inlet within said given operating range.

9. Method according to claim 8, wherein said drawing machines draw the material to be drawn in parallel operating directions,comprising the steps of: deflecting the material to be drawn by said guiding device through substantially 180° of arc.

10. Method according to claim 8, comprising the steps of: driving said crossbar by means of a rotational drive.

* * * * *